US006621999B2

(12) United States Patent
Miho

(10) Patent No.: US 6,621,999 B2
(45) Date of Patent: Sep. 16, 2003

(54) DEVELOPING DEVICE AND IMAGE FORMING APPARATUS

(75) Inventor: Hiroaki Miho, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/108,876

(22) Filed: Mar. 28, 2002

(65) Prior Publication Data

US 2003/0031481 A1 Feb. 13, 2003

(30) Foreign Application Priority Data

Apr. 3, 2001 (JP) ..... 2001-104494

(51) Int. Cl.[7] ..... G03G 15/08; G03G 15/06; G03G 9/00

(52) U.S. Cl. ..... 399/252; 399/222; 430/110.3; 430/110.4

(58) Field of Search ..... 399/222, 223, 399/252, 265, 285; 430/107.1, 110.1, 110.3, 110.4

(56) References Cited

U.S. PATENT DOCUMENTS 5,578,407 A * 11/1996 Kasuya et al. ..... 430/110.3 X
5,712,072 A * 1/1998 Inaba et al. ..... 430/110.3 X
5,849,453 A * 12/1998 Mikuriya et al. ..... 430/110.4 X
6,040,103 A * 3/2000 Ohno et al. ..... 430/110.3 X
6,169,869 B1 * 1/2001 Inami et al. ..... 399/285 X
6,284,424 B1 * 9/2001 Iimura et al. ..... 430/110.4

* cited by examiner

*Primary Examiner*—Sandra Brase
(74) *Attorney, Agent, or Firm*—Squire, Sanders & Dempsey, L.L.P.

(57) ABSTRACT

A developing device for developing a static latent image is disclosed. The relation between an average of the circle corresponding diameter of the toner aggregates in the toner image on the image carrier surface formed by developing the static latent image and a value obtained by dividing the standard deviation of a circle corresponding diameter of the toner aggregate by the average circle corresponding diameter of the toner aggregates satisfies following Formula 1.

$$0<Y<179.01\times X^{-1.9031}$$

wherein X is a diameter of the circle corresponding to toner aggregate in $\mu$m (X>20 $\mu$m), and Y is CV1, CV1=Standard deviation of the circle corresponding diameter of the toner aggregate/Average of the circle corresponding diameter of the toner aggregates X.

12 Claims, 5 Drawing Sheets

DEVELOPING DEVICE AND IMAGE FORMING APPARATUS

FIELD OF THE INVENTION

This invention relates to a developing device by which fluctuation of the diameter of a toner dot image after development is inhibited, and an image forming apparatus having the developing device.

BACKGROUND OF THE INVENTION

Noise on an image formed a copying machine and a printer is usually evaluated by the output image after the development and fixation. When the noise is roughly classified into a microscopic noise such as the variation of the size and the shape of the dots when the image is formed by the dots screen and the fluctuation of line width when the image is formed by lines, and macroscopic noise such as the fluctuation of the latent image caused by unevenness of the photoreceptor speed, the microscopic noise is increased in each of the courses of latent image formation, development, transferring and fixation. The image after the development for visualizing the latent image is important to reduce the noise on the final image. When the diameters of the dots after the development are largely fluctuated, the noise on the final image cannot be reduced even though the degradation of the nose in the transfer and fixation processes is inhibited.

Particularly, in the case of an image forming apparatus having developing devices in tandem and an immediate transfer member, a toner image formed on a photoreceptor drum is transferred onto an image transferring medium and then the next color toner image formed on another drum is transferred onto the same image transferring-medium. In this processes, the toner image previously transferred is reversely transferred. The noise is increased since the toner image is disordered by the reversely transfer. Therefore, the fluctuation of the diameter of the dot of the toner image formed on the photoreceptor drum by the development is to be inhibited.

SUMMARY OF THE INVENTION

The object of the invention is to provide a development device and an image forming apparatus by which the fluctuation of the dot diameter of the developed image can be inhibited into the unrecognizable range and the noise on the final image can be reduced. Further object of the invention is to provide a developing device and an image forming apparatus by which the fluctuation of the diameter of the developed dot image can be inhibited so as to make narrow the fluctuation after development and the noise on the final image can be reduced.

The invention is attained by the find by the inventors that the fluctuation of the developed dots on the image carrier is reduced and the noise on the final image is lowered when the fluctuation of the diameter of the circle corresponding to the aggregate of the toner, hereinafter referred to as the circle corresponding diameter of the toner aggregate, is small so as to satisfy the following Formula 1.

The developing device according to the invention is a developing device for developing a static latent image composed of dots formed on an image carrier, in which the relation between the average of the circle corresponding diameter of the toner aggregates in the toner image on the image carrier surface formed by developing the static latent image and the value obtained by dividing the standard deviation of the circle corresponding diameter of the toner aggregate by the average circle corresponding diameter of the toner aggregates, hereinafter referred to as CV1, satisfies the following Formula 1.

$$0<Y<179.01\times X^{-1.9031} \quad (1)$$

X: The diameter of the circle corresponding to toner aggregate in $\mu$m (X>20 $\mu$m)

Y: CV1=Standard deviation of the circle corresponding diameter of the toner aggregate/Average of the circle corresponding diameter of the toner aggregates X The outline of the dot can be correctly reproduced since the each of the dots can be formed by many toner particles because the toner with a small diameter is used in the developing device. A volume average particle diameter of the toner particles is preferably from 2 to 7 $\mu$m.

The volume variation coefficient of the toner is preferably not more than 22. The volume variation coefficient is a value obtained by dividing the standard deviation by the volume average particle diameter and multiplying by 100 times, hereinafter the value is referred to as CV2. In such the toner, particle diameter distribution is narrow and the charged electricity of the each toner particle is made uniform. Accordingly, the development selectivity of the toner to the static latent image on the image carrier is reduced when the image carrier is entered into the developing zone so that the uniform development can be attained.

In a histogram showing the particle diameter distribution based on the particle number in which natural logarithm ln D classified by every 0.23 is taken on the horizontal axis, wherein D is the particle diameter of the toner particle in $\mu$m, and the sum M of the relative number m1 of the toner particles included in the class of the highest frequency and the relative number m2 of the toner particles included in the class of next high frequency is preferably not less than 65%. In such the toner, the diameter distribution of the toner particles is made narrow. Consequently, the occurrence of the selective development can be surly prevented by the use of such the toner.

It is preferable that the ratio of the toner particles having the foregoing shape coefficient of the toner of from 1.2 to 1.6 is not less than 60% by volume and the variation coefficient of the shape coefficient is not more than 18%.

It is also preferable to apply an alternating current voltage overlapped with a direct current voltage to a developer carrier charged in the developing device. The amounts of the toners adhered onto each of the latent image can be made uniform by applying the alternating current voltage overlapped with the direct current voltage since the toner is gone and returned between the latent image and the developing device such as a developing sleeve according to the AC frequency. The toner particle is pulled back by the AC even if the toner is excessively adhered on the latent image.

The developing device according to the invention is a developing device for developing a static latent image composed of dots formed on the image carrier. The developing device is charged in an image forming apparatus by which four color images are each formed on the image carriers by developing by the toners Y, M, C and K, respectively, and the images are successively transferred onto the same intermediate transferring member or the same recording medium set on the intermediate transferring member. In the developing device, the relation between the average of the circle corresponding diameter of the toner aggregates of the toner image on the image carrier surface formed by developing the static latent image and the value obtained by dividing the standard deviation of the diameter of the circle corresponding to the toner aggregate by the average diameter of the circle corresponding to the toner aggregates, hereinafter referred to as CV1, satisfies the following Formula.

$$0<Y<90.307\times X^{1.7589} \quad (2)$$

X: Average circle corresponding diameter of the toner aggregate in $\mu$m (X>20 $\mu$m)

Y: CV1=Standard deviation of the circle corresponding diameter of the toner aggregate/Average diameter of the circle corresponding to the toner aggregates X In the case of the development in the image forming apparatus having the tandem structure, it is found that when the fluctuation of the diameter of the aggregate of each of the four color toners on each of the image carriers is small so as to satisfy the foregoing Formula 2, the fluctuation of the dots on each of the image carriers is made small and the noise on the final image is reduced. Thus the invention is attained. The outline of the dot can be correctly reproduced since the each of the dots can be formed by many toner particles because the toner with a small diameter is used in the developing device. In such the case, it is preferable that the volume average particle diameter is from 2 to 6.5 $\mu$m.

The volume variation coefficient of the toner is preferably not more than 20. The volume variation coefficient is a value obtained by dividing the standard deviation by the volume average particle diameter and multiplying by 100 times, hereinafter the value is referred to as CV2. In such the toner, particle diameter distribution is narrow and the charged electricity of the each toner particle is made uniform. Accordingly, the development selectivity of the toner to the static latent image on the image carrier is reduced when the image carrier is entered into the developing zone, so that the development can be carried out uniformly.

In a histogram showing the particle diameter distribution based on the particle number in which natural logarithm ln D classified by every 0.23 is taken on the horizontal axis, wherein D is the particle diameter of the toner particle in $\mu$m, and the sum M of the relative number m1 of the toner particles included in the class of the highest frequency and the relative number m2 of the toner particles included in the class of next high frequency is preferably not less than 70%. In such the toner, the diameter distribution of the toner particles is made narrow. Consequently, the occurrence of the selective development can be surly prevented by the use of such the toner.

It is preferable that the ratio of the toner particles having the foregoing shape coefficient of the toner of from 1.2 to 1.6 is not less than 65% by volume and the variation coefficient of the shape coefficient is not more than 16%.

It is also preferable to apply an alternating current voltage overlapped with a direct current voltage to a developer carrier charged in the developing device. The amounts of the toners adhered onto the each latent image can be made uniform by applying the alternating current voltage overlapped with the direct current voltage since the toner goes and returns between the latent image and the developing device such as a developing sleeve according to the AC frequency. The toner particle is pulled back by the AC even if the toner is excessively adhered on the latent image.

The image forming apparatus can give a final image with a low noise by having each the foregoing developing device.

2: Photoreceptor drum (image carrier)

3: Developing device

11: Developing sleeve

2Y, 2M, 2C, 2K: Photoreceptor drum (image carrier)

3Y, 3M, 3C, 3K: Developing device

15: Intermediate transfer belt (intermediate transfer member)

DETAILED DESCRIPTION OF THE INVENTION

The first and second embodiments according to the invention are described below referring the drawings.

The First Embodiment

Figure 1:
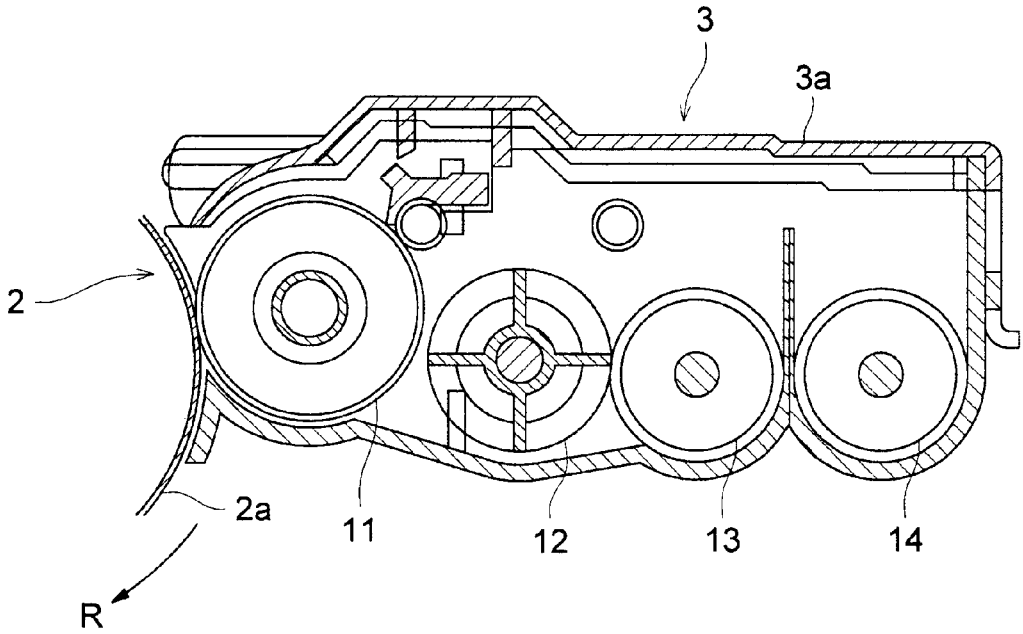
FIG. 1 shows a side view cross section of a developing device according to the first embodiment of the invention.
Figure 2:
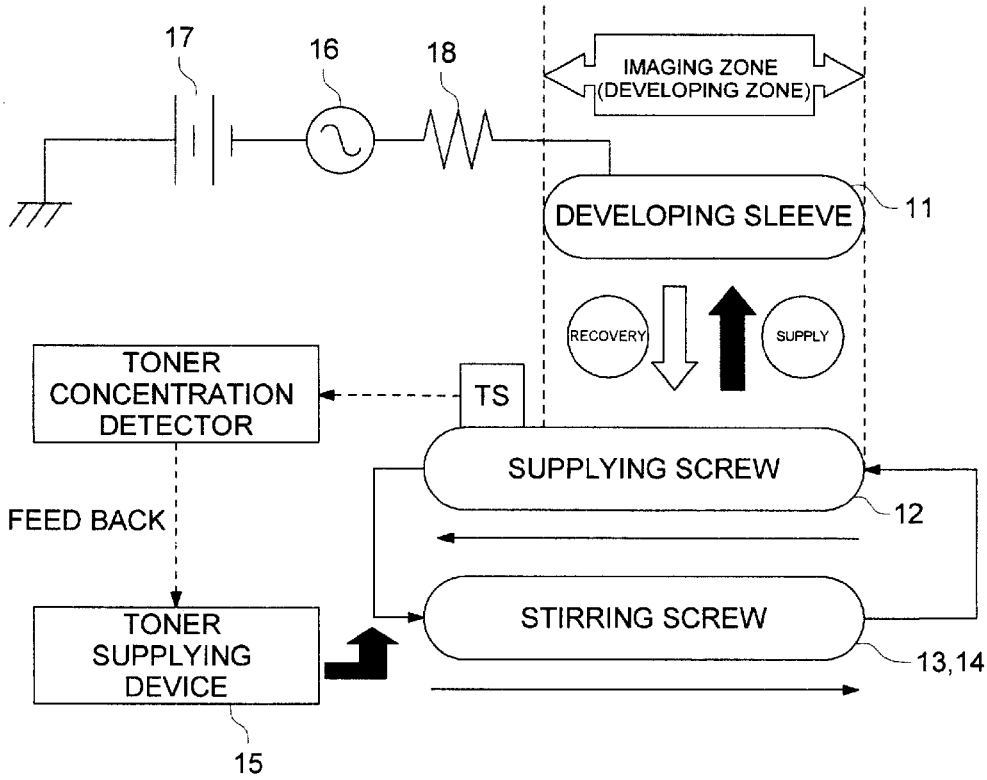
FIG. 2 is a drawing for describing the function of the developing device shown in FIG. 1.

FIG. 1 is a drawing of a side view cross section of a developing device according to the first embodiment of the invention and FIG. 2 is a drawing for describing the function of the developing device shown in FIG. 1.

As is shown in FIG. 1, the developing device 3 has a developing sleeve 11 which rotates to supply the toner to the exterior surface 2*a* of the photoreceptor 2 so as to develop the latent image consisting of dots formed on the surface 2*a*, a tone supplying screw 12 which rotates so as to supply the toner to the developing sleeve 11, and stirring screws 13 and 14 which stirs the toner by rotating in a box 3*a* of the developing device.

As is shown in FIG. 2, the supplying screw 12 supplies the toner to the developing sleeve 11 and simultaneously recovers the toner remaining on the developing sleeve. The recovered toner is stirred by the stirring screws 13 and 14 and supplies to the developing sleeve 11 through the supplying screw 12. An image forming zone or the developing zone is formed on the photoreceptor drum 2 of FIG. 1 in the lengthwise direction of the developing sleeve 11. A toner sensor TS arranged near the supplying screw 12 detects the concentration of the toner, and the detection result is feed backed to a toner supplying device 15 so as to supply the toner into the box of the developing device 3.

As is shown in FIG. 2, an alternating current bias power source 16 and a direct current bias powder source 17 are connected in series through a resister 18 to the circumstance surface of the developing sleeve 11. Toner is charged by the direct current bias voltage overlapped with the alternating current bias voltage supplied from the alternating current power source 16 and the direct current power source 17 so that the toner on the exterior surface of the developing sleeve 11 is adhered to the static latent image formed on the circumference of the photoreceptor drum. The negatively charged toner is attracted to the circumference surface of the photoreceptor drum by the effect of the electric field since the potential of the circumference surface of the photoreceptor drum, on which the static latent image is formed, is higher by the contrast potential than the voltage of the developing DC bias.

Thus developed toner image on the photoreceptor drum is then transferred onto the recording medium by the transferring device. The image transferred on the recording medium is fixed to make the final image. The developing device according to the embodiment of the invention is applied for the black-and-white developing device and for each of the Y, M, C and K developing devices.

In the foregoing developing device 3, the toner aggregate in the developed image satisfies the following Formula 1. The effects of that are as follows, which is further described according to the later-mentioned examples.

$$0<Y<179.01\times X^{-1.9031} \quad (1)$$

X: The circle corresponding diameter of the toner aggregates in $\mu$m (X>20 $\mu$m)

Y: CV1=Standard deviation of the circle corresponding diameter of the toner aggregates/Average diameter of the circle corresponding to the toner aggregates X It is preferable that the volume average particle diameter of the toner after development is from 2 to 7 $\mu$m and the volume variation coefficient of the toner CV2, (Standard deviation/Volume average particle diameter)×100, is not more than 22.

When the foregoing toner is used, and the fluctuation of the circle corresponding diameter of the aggregates of the toner in the developed image is small so as to satisfy Formula 1 on the circumference of the photoreceptor drum 2, the noise on the final image is reduced and the outline of the dot can be correctly reproduced since the image of the dot of the latent image can be formed by many fine toner particles. In such the toner, particle diameter distribution is narrow and the charged electricity of the each toner particle is made uniform. Consequently, the development selectivity of the toner to the static latent image on the image carrier is reduced when the image carrier is entered into the developing zone so that the uniform development can be attained.

The amounts of the toners adhered onto the each of the latent images can be made uniform by applying the AC bias overlapped with the DC bias since the toner goes and returns between the latent image and the developing device such as a developing sleeve according to the AC frequency. The toner particle is pulled back by the AC even if the toner is excessively adhered on the latent image.

EXAMPLES

Example 1

Development was performed under the following conditions using an image forming apparatus having the developing device shown in FIGS. 1 and 2 and the photoreceptor drum 2 shown in FIG. 1. Then the average circle corresponding diameter of the aggregates of the toner developed on the circumference surface 2*a* was measured.

Developing Conditions

Dws (carrying amount of developer on the sleeve): 30 mg/cm$^2$

Dsd (distance between the photoreceptor drum 2 and the developing sleeve 3): 0.5 mm Vh (charged potential of the photoreceptor drum 2): −800 V Vdc (DC developing bias supplied by the direct current bias power source 17): −650 V Vac (AC developing bias supplied by the alternating current bias power source 16): 2 kV, 1 kHz Resolution of the dot: 200 dpi Vs/Vp: 1.8

Two kinds of toner were prepared which were different from each other in the particle diameter distribution. The CV1 value, standard deviation/average circle corresponding diameter X, of the toner aggregate on the photoreceptor was measured by the following method. The image was observed by a Kiense microscope with a magnitude of 175 times using WinRoof software. The image analyzing was carried out according to the following flow: reading the image and converting it to a black-and-white image, calibrating the image dimensions, setting the measuring area, reversing the image, setting the inertia value, and calculating the diameter of the toner aggregate. The number of the subjected toner aggregates was 200.

The volume average particle diameter can be measured by Coulter Counter TA-II or Coulter Multisizer. The measurement was carried out by a laser diffraction particle diameter measuring apparatus SLAD 1100 manufactured by Shimadzu Corp.

The volume average diameter of each of the two kinds of toner, the CV1 value and the CV2 value, (standard deviation/volume average particle diameter)×100, were determined. Two kinds of development were carried out as Comparative Examples 1 and 2 each using the toner having the larger volume average diameter, one of which was performed with the DC bias only and another was performed with the DC bias overlapped with the AC bias. The development using the toner having the smaller volume average diameter was carried out as Example 1 while applying the DC bias overlapped with the AC bias. The appearance noise on the final image obtained by each of the developments was evaluated. The results are shown in Table 1.

TABLE 1

| Example | Comparative example | Volume average particle diameter ($\mu$m) | Particle diameter distribution (CV2 value) | Sum of relative frequency | Ratio of shape coefficient | Variation coefficient of shape coefficient | Bias | Appearance of noise on final image |
|---|---|---|---|---|---|---|---|---|
| | 1 | 8 | 25 | 54 | 56 | 23 | DC only | C |
| | 2 | 8 | 25 | 54 | 56 | 23 | DC only | B |
| 1 | | 7 | 21 | 67 | 62 | 18 | DC + AC | A |

Evaluation of the appearance noise on the final image:

C: Poor

B: Normal

A: Good

Figure 3:
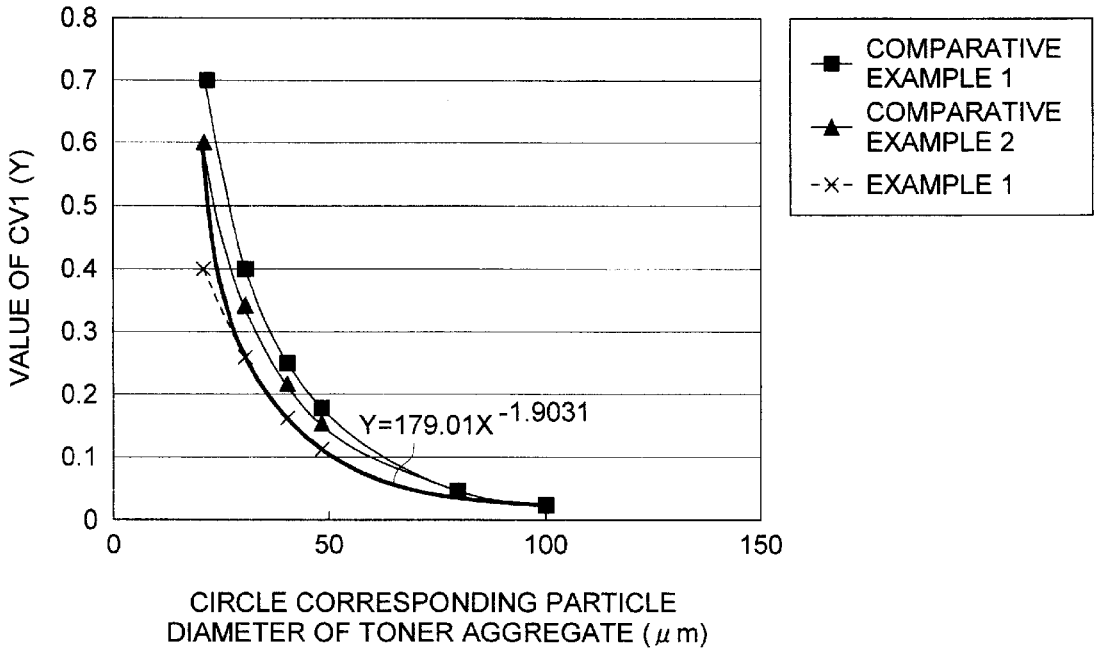
FIG. 3 shows a graph showing the relation between the average circle corresponding diameter of the toner aggregate X in $\mu$m and the CV1 value for describing Example 1 according to the first embodiment of the invention and Comparative Examples 1 and 2.

The relations between the circle corresponding diameter of the toner aggregate X ($\mu$m) and the CV1 value in Example 1 and Comparative examples 1 and 2 were shown in FIG. 3. It is cleared by FIG. 3 that Formula 1 is not satisfied in Comparative examples 1 and 2, in which the toner having the volume average particle diameter of 8 $\mu$m and the CV2 value of the particle diameter distribution of 25 is used, and the DC bias or the DC bias overlapped with AC bias is applied. Besides, Formula 1 is satisfied in Example 1, in which the toner having the volume average particle diameter of 7 $\mu$m and the CV2 value of the particle diameter distribution of 21 is used, and the DC bias overlapped with AC bias is applied. As is shown in Table 1, in the cases of Comparative examples 1 and 2, in which the CV1 Value does not satisfy Formula 1 with respect to the circle corresponding diameter ($\mu$m) of the toner aggregate, the noise on the final image is increased. Contrary to that, in Example 1 satisfying Formula 1, the noise on the final image is reduced and a good noise property can be obtained.

Second Embodiment

Figure 4:
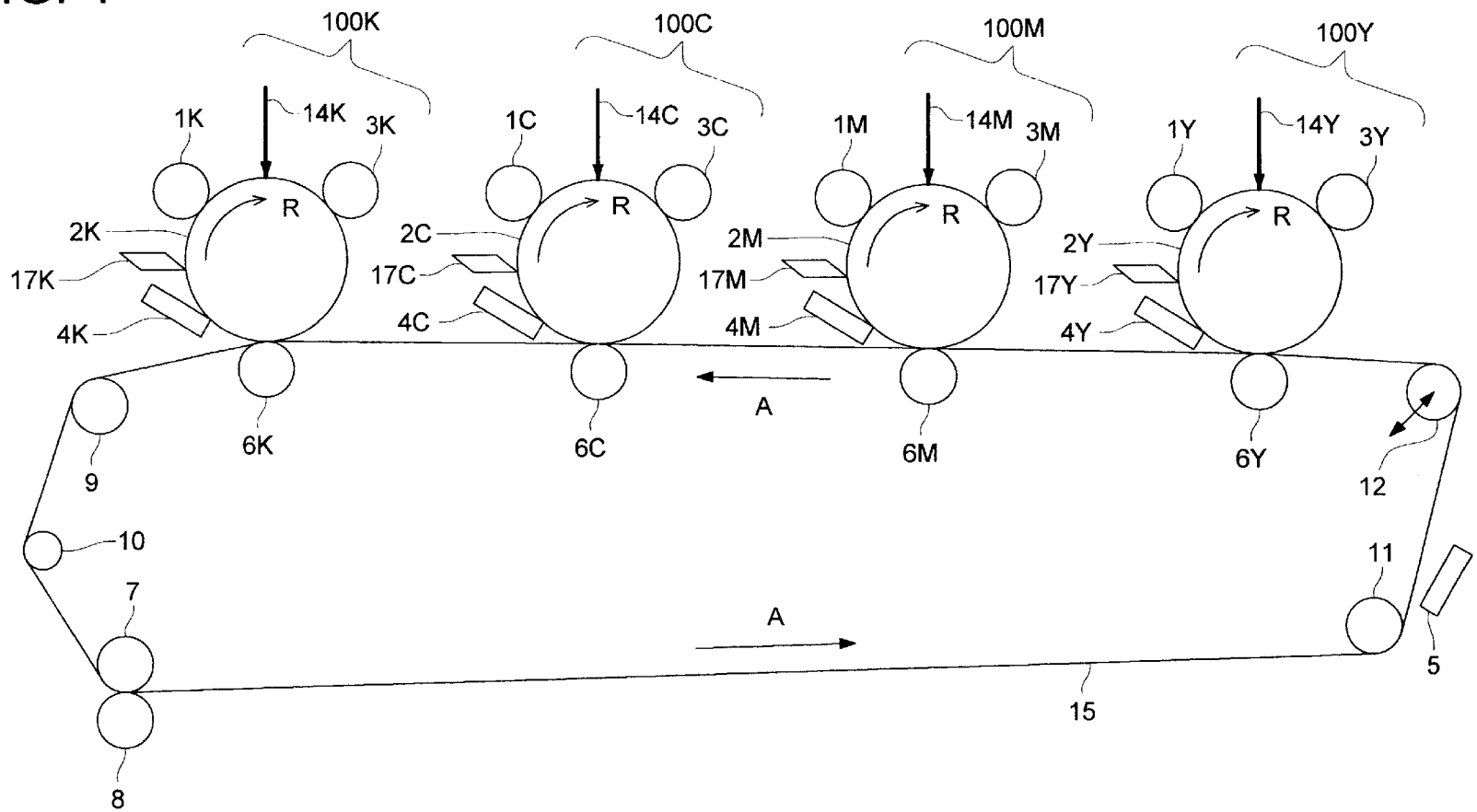
FIG. 4 shows a side view of the schematic construction of an image forming apparatus with a tandem structure having the developing devices according to the first embodiment of the invention.

FIG. 4 shows a drawing of schematic construction of a color image forming apparatus with a tandem structure including a developing device according to the invention. The image forming apparatus shown in FIG. 4 includes four-color image forming systems, 100Y, 100M, 100C and 100K and an intermediate transfer belt. As is shown in FIG. 4, four color of images are each formed by the four color image forming systems, 100Y for a yellow color component, 100M for a magenta color component, 100C for a cyan color component and 100K for a black color component. The constitution and the action of the image forming system is described below as to the black image forming system 100K.

The photoreceptor drum 2K in the image forming system 100K is clockwise rotated in the direction of the arrow R in the drawing. The surface of the photoreceptor drum 2K is charged at a charged potential of a relatively high negative potential by a charging roller 1K in the drawing. Then the surface of the charged photoreceptor drum 2K is exposed to a laser light beam 14K from an exposing means, not shown in the drawing. The potential at the exposed area is varied to an exposed potential since a light-sensitive layer is formed on the surface of the photoreceptor 2K. Thus a static latent image consisting of dots is formed on the photoreceptor drum 2K.

The developing device 3K has the constitution the same as the developing device 3 shown in FIGS. 1 and 2. A developing sleeve the same as the developing sleeve 11 in FIGS. 1 and 2 is rotated to supply a toner charged at a negative potential by the bias power source while rubbing with the surface of the photoreceptor drum 2K. The toner is adhered onto the surface of the photoreceptor drum 2K. The adhesion is performed by applying the developing AC bias while maintaining the developing device 3K containing the black colored toner at a developing DC bias potential. The negatively charged toner is attracted to the photoreceptor 2 by the effect of the electric field since the potential of the exposed area of the photoreceptor drum 2K surface is higher than potential of the developing DC by the contrast potential. Thus a toner image is formed according to the static latent image on the photoreceptor drum 2K.

The toner image is transferred onto an intermediate transfer belt 15 by a primary transfer roller 6K. The surface of the photoreceptor drum 2K is cleaned by a photoreceptor cleaning blade 4K to wipe off the remaining toner after the transfer. The surface of the photoreceptor drum 2K is discharged by PCL 17K to erase the hysteresis. Thus the surface of the photoreceptor 2K is made to the electrically uniform initial state.

Each of static latent images is respectively developed by C, Y and M toner on each of the photoreceptor drums 2C, 2M and 2Y to form toner images. The image forming system 100Y for yellow color component, the image forming system 100M for magenta color component and the image forming system 100C for cyan color component each has the same structure as the foregoing image forming system 100K, and the same part is named by the same sign and distinguished by Y, M and C at the last of the sign.

As is shown in FIG. 4, the intermediate transfer belt system has an intermediate transfer belt 15, intermediate belt supporting rollers 9 and 10, an intermediate belt driving roller 11, an intermediate belt tensing roller 12, a secondary transfer backup roller 7 and a secondary transfer roller facing to the secondary transfer backup roller 7.

When the intermediate transfer belt driving roller 11 is rotated by a motive power, not shown in the drawing, the intermediate transfer belt is progressed in the direction A in FIG. 1 while synchronizing with the rotation of photoreceptor drums 2Y, 2M, 2C and 2K. According to such the order, the toner image of the yellow component of the color image is transferred to the transfer belt at the position between the photoreceptor drum 2Y and the primary transfer roller 6Y, the toner image of the magenta component is transferred to the transfer belt at the position between the photoreceptor drum 2M and the primary transfer roller 6M, the toner image of the cyan component is transferred to the transfer belt at the position between the photoreceptor drum 2C and the primary transfer roller 6C, and the toner image of the black component is transferred to the transfer belt at the position between the photoreceptor drum 2K and the primary transfer roller 6K. The intermediate transfer belt 15 on which those four color components is passed between the secondary transfer roller 8 and the secondary transfer backup roller 7. At this time, the image on the intermediate transfer roller 15 is secondarily transferred onto the recording medium, not shown in the drawing, which is supplied with a suitable timing between the secondary transfer roller 8 and the intermediate transfer belt 15. Thus an image is formed on the recording medium and fixed to form a final image. The intermediate transfer belt 15 is cleaned by an intermediate transfer cleaning blade 5 after the secondary transfer so as to perform next image transfer.

In each of the developing devices 3K, 3C, 3M and 3Y, the aggregates on the photoreceptors K, C, M and Y are each satisfies Formula 1, the effect of such the fact is as follows and further described in the later example.

$$0<Y<90.307\times X^{-1.7589}$$

X: Average circle corresponding diameter of the toner aggregate in $\mu$m (X>20 $\mu$m)

Y: CV1=Standard deviation of the circle corresponding diameter of the toner aggregate/Average circle corresponding diameter of the toner aggregates X It is preferable that the volume average particle diameter of each of the toners after development is not more than 65 $\mu$m and the variation coefficient the volume of toner CV2, (standard deviation/volume average particle diameter)×100, is not more than 20.

When such the toner is used, the outline of the dot can be correctly reproduced since the each of the dots can be formed by many toner particles because the toner with a small diameter is used in the developing device. Moreover, the particle diameter distribution represented by the volume average particle diameter is narrow and the charged electricity of the each toner particle is made uniform.

Accordingly, the development selectivity of the toner to the static latent image on the image carrier is reduced when the image carrier is entered into the developing zone, so that the uniform development can be attained.

Until now, when the toner image formed for instance on the photoreceptor drum 2Y is transferred onto the intermediate transfer belt 15 and the next toner image formed on the photoreceptor drum 2M is transferred on the intermediate transfer belt 15, the previously transferred yellow toner is reversely transferred to the photoreceptor drum 2M so that the toner image on the intermediate transfer belt 15 may be often disarranged. However, the degradation of the noise on the final image can be prevented by reducing the fluctuation of the circle corresponding diameter of the each toner aggregates on the photoreceptors 2K, 2C, 2M and 2Y to within the range of Formula 2.

The amount of the toner adhered onto the static latent image can be made uniform by overlapping AC bias to DC bias since the toner is gone and returned between the static latent image and the sleeve according to the AC frequency even if the toner is excessively adhered to the static latent image.

Example 2

Developments were performed using an image forming apparatus shown in FIG. 4 under the following conditions, and the circle corresponding diameter of the toner aggregate was measured on each of the photoreceptor drums 2K, 2C, 2M and 2Y.

Developing Conditions

- Dws (carrying amount of developer on the sleeve): 30 mg/cm$^2$
- Dsd (distance between the photoreceptor drum 2 and the developing sleeve 3): 0.5 mm
- Vh (charged potential of the photoreceptor drum 2): −800 V
- Vdc (DC developing bias supplied by the direct current bias power source 17): −650 V
- Vac (AC developing bias supplied by the alternating current bias power source 16): 2 kV, 1 kHz
- Resolution of the dot: 200 dpi
- Vs/Vp: 1.8

Two kinds of toner were prepared which were different from each other in the particle diameter distribution. The CV1 value, standard deviation/average corresponding circle diameter X of the toner aggregate on the photoreceptor, was measured by the following procedure. The image was observed by a Kiense microscope with a magnitude of 175 times using WinRoof software. The image analyzing was carried out according to the following flow: reading the image and converting it to a black-and-white image, calibrating the image dimensions, setting the measuring area, reversing the image, setting the inertia value, and calculating the diameter of the toner aggregate. The number of the subjected toner aggregates was 200.

The volume average particle diameter can be measured by Coulter Counter TA-II or Coulter Multisizer. The measurement was carried out by a laser diffraction particle diameter measuring apparatus SLAD 1100 manufactured by SHIMADZU Corp.

The volume average diameter of each of the two kinds of toner, the CV1 value and the CV2 value, (standard deviation/volume average particle diameter)×100, were determined. Two kinds of development were carried out as Comparative Examples 1 and 2 each using the toner having the larger volume average diameter, one of which was performed with the DC bias only and another was performed with the DC bias overlapped with the AC bias. The development using the toner having the smaller volume average diameter was carried out as Example 1 while applying the DC bias overlapped with the AC bias. The appearance noise on the final image obtained by each of the developments was evaluated. The results are shown in Table 2.

TABLE 2

| Example | Comparative example | Volume average particle diameter (μm) | Particle diameter distribution (CV2 value) | Sum of relative frequency | Ratio of shape coefficient | Variation coefficient of shape coefficient | Bias | Appearance of noise on final image |
|---|---|---|---|---|---|---|---|---|
| | 3 | 8.0 | 25 | 54 | 56 | 23 | DC only | C |
| | 4 | 8.0 | 25 | 54 | 56 | 23 | DC only | C |
| 2 | | 6.5 | 20 | 70 | 65 | 16 | DC + AC | A |

Evaluation of the appearance noise on the final image:
C: Poor
A: Good

Figure 5:
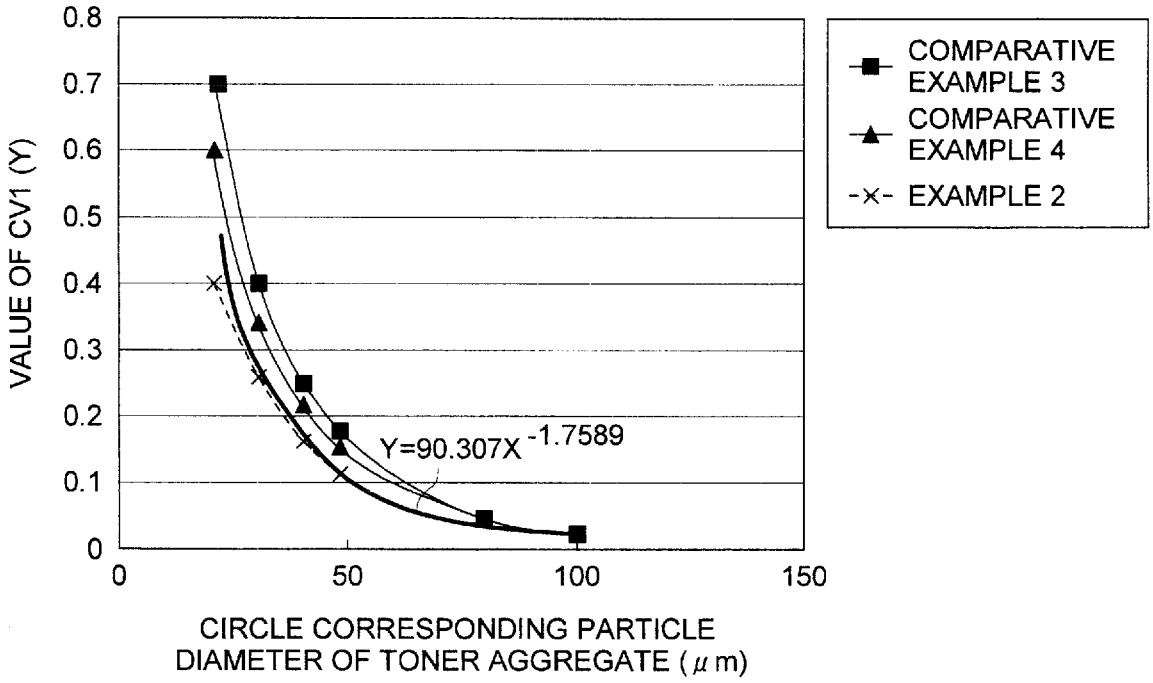
FIG. 5 shows a graph showing the relation between the average circle corresponding diameter of the toner aggregate X in $\mu$m and the CV1 value for describing Example 2 according to the second embodiment of the invention and Comparative Examples 3 and 4.

The relations between the circle corresponding diameter of the toner aggregate X (μm) and the CV1 value in Example 2 and Comparative examples 3 and 4 were shown in FIG. 5. It is cleared by FIG. 5 that Formula 2 is no satisfied in Comparative examples 3 and 4, in which the toner having the volume average particle diameter of 8 μm and the CV2 value of the particle diameter distribution of 25 is used, and the DC bias or the DC bias overlapped with AC bias is applied. Besides, Formula 2 is satisfied in Example 2, in which the toner having the volume average particle diameter of 7 μm and the CV2 value of the particle diameter distribution of 21 is used, and the DC bias overlapped with AC bias is applied. As is shown in Table 2, in the cases of Comparative examples 3 and 4, in which the CV1 value does not satisfy Formula 2 with respect to the circle corresponding diameter (μm) of the toner aggregate, the noise on the final image is increased. Contrary to that, in Example 2 satisfying Formula 2, the noise on the final image is reduced and a good noise property can be obtained.

The evaluation items and the definitions in Examples 1 and 2 are described in detail below.

1. Toner Diameter

The diameter of the toner to be used in the examples is preferably from 2 to 7 μm for Example 1 and from 2 to 6.5

μm for Example 2. When such the toner is used, the outline of the dot can be correctly reproduced since the each of the dots can be formed by many toner particles because the toner with a small diameter is used by the developing device. When the particle diameter is 2 μm or less, the adhesive force to the image carrier by van der Waals force becomes excessively strong so as to raise a problem that the cleaning is made difficult. The particle diameter can be controlled in the producing process by controlling the concentration of a coagulation agent or a salting agent, the adding amount of the organic solvent, adhering time and the composition of the polymer.

Calculation of the particle diameter distribution and measurement of the number average particle diameter can be carried out by the use of Coulter Counter TA II, Coulter Multisizer, both of those are manufactured by Coulter Co., Ltd., or laser diffraction particle size measuring apparatus SLAD 1100 manufactured by SHIMADZU Corp. In the invention, the measurement and the calculation are carried out by Coulter Multisizer which is connected with a personal computer through an interface, manufactured by Nikkaki Co., Ltd., for outputting the particle diameter distribution.

2. Volume Particle Diameter Distribution and Volume Variation Coefficient

The volume particle diameter distribution and the volume variation coefficient in the invention are measured by Coulter Counter TA-II or Coulter Multisizer manufactured by Coulter Co., Ltd. In this example, Coulter Multisizer is used, which is connected with a personal computer through an interface, manufactured by Nikkaki Co., Ltd., for outputting the particle diameter distribution. The volume diameter is measured by the use of an aperture of 100 μm in Coulter Multisizer and the particle diameter distribution and the average particle diameter are calculated. The volume particle diameter distribution represents the relative frequency of the toner particle diameter, and the volume average particle diameter represents the diameter in the volume particle diameter distribution at which the accumulation of the frequency of the particle attains to 50% or Dn50.

The volume variation coefficient of the volume particle diameter distribution of the toner is calculated by the following Formula.

$$\text{Volume variation coefficient}=[S/Dn]\times 100\%$$

In the Formula, S is standard deviation in the volume particle diameter distribution and Dn is the volume average particle diameter in μm.

The volume variation coefficient is preferably not more than 22 in Example 1 and not more than 20 in Example 2. The particle diameter distribution is narrow in such the toner. Therefore, the charge of each toner particle is made uniform and the development selectivity of the toner to the static latent image on the image carrier is reduced when the image carrier is entered into the developing zone, so that the uniform development can be attained. In the invention, there is no limitation on the method for controlling the volume variation coefficient of the toner. For instance, a method for classifying the toner particles by wind may be used. However, the classification in a liquid is effective to further reduce the volume variation coefficient. The method for classifying in the liquid include a method using a centrifuge by which the toner particles are classified by controlling the rotating speed of the centrifuge according to the difference of the sedimentation speed of the particles and recovered to prepare the classified toner.

The selective developing ability is described below. Generally, individual toner particles are each different in the particle diameter, shape and charge amount thereof. Consequently, the toner includes toner particles which are easily released from the carrier to contribute to the development, and particles which difficultly contribute to the development when a development electric field is applied. In a system, in which the selective development is considerably occurred, the toner particles easily contributing to the development are preferentially consumed and the toner particles difficultly contributing to the development are accumulated in the developing device. In such the situation, the latent image of the dots cannot be uniformly developed and the noise is increased.

3. Particle Diameter Distribution of the Toner

In a histogram showing the particle diameter distribution based on the particle number in which natural logarithm ln D classified by every 0.23 is taken on the horizontal axis, wherein D is the particle diameter of the toner particle in μm, and the sum M of the relative number m1 of the toner particles included in the class of the highest frequency and the relative number m2 of the toner particles included in the class of next high frequency is preferably not less than 65% in Example 1 and not less than 70% in Example 2.

When the sum M of the relative frequency m1 and the relative frequency m2 is not less than 65%, the fluctuation of the particle diameter distribution of the toner is made narrow. Consequently, the occurrence of the selective development can be surely inhibited by the use of such the toner for the image formation process.

In the examples, the histogram of the particle diameter distribution based on the volume is a histogram showing the particle diameter distribution according to the volume classified into plural classes by every 0.23 of natural logarithm ln D (0–0.23, 0.23–0.46, 0.46–0.69, 0.69–0.92, 0.92–1.15, 1.15–1.38, 1.38–1.61, 1.61–1.84, 1.84–2.07, 2.07–2.30, 2.30–2.53, 2.53–2.76, . . . ) of the diameter D of individual particle. The histogram is prepared by the following procedure:

Data of the particle diameter of the sample measured by Coulter Multisizer under the following conditions are transmitted to a computer through an I/O unit and the histogram is prepared by the computer with a particle diameter distribution analyzing program.

Measuring Conditions

Aperture: 100 μm

Preparation of Sample:

A suitable amount of a surfactant, a neutral washing detergent, is added to an electrolyte solution, ISOTON II, manufactured by Coulter Scientific Japan Co., Ltd., and stirred, and 10–20 mg of the sample to be measured is added to the solution. Thus obtained mixture is subjected to dispersing by a ultrasonic dispersion apparatus for 1 minute.

Shape Coefficient of Toner

The shape coefficient is described below. In Example 1, it is preferred that the toner according to the invention contains toner particles having a shape coefficient of from 1.2 to 1.6 in a content of not less than 60% by volume, a variation coefficient of the shape coefficient of not more than 18% and a volume variation coefficient in the volume particle diameter distribution of not more than 22%. In Example 2, it is preferred that the toner contains toner particles having a shape coefficient of from 1.2 to 1.6 in a content of not less than 65% by volume, a variation coefficient of the shape coefficient of not more than 16% and a volume variation coefficient in the volume particle diameter distribution of not more than 20%. When the shape coefficient is less than 1.2, the transferring ability is degraded and the cleaning is made difficult so as to occur toner passing under the cleaning blade. When the shape coefficient is more than 1.6, the surface charge density of the toner is lowered so as to tend to cause fluctuation of the toner. When the variation coefficient of the shape coefficient is not more than 16%, the charge of each of the toner particles is made uniform and the selectivity of the toner to the dot latent image is lowered. Thus development can be uniformly performed. The shape coefficient calculated by the following Formula represents the roundness of the toner particle.

$$\text{Shape coefficient}=\pi\times(\text{maximum diameter}/2)^2/\text{procection area}$$

The maximum diameter is defined by the largest distance between two parallel lines each tangent to the projected image of the toner particle on a plane. The projection area is an area of the projected image of the toner particle on a plane. In the examples, the shape coefficient is determined by photographing the toner particles with a magnitude of 2000 times by a scanning electronmicroscope and analyzing thus obtained photography by the use of Scanning Image Analyzer manufactured by Nihon JEOL Ltd. The shape coefficients in the Examples are each determined by the foregoing Formula as to 100 particles of the toner.

The preparation method of the toner of the example is described below. Resin particles for the toner, Latex 1HML, were prepared as follows.

(1) Preparation of Core Particle (The First Step of Polymerization)

A surfactant solution prepared by dissolving 7.08 g of nonionic surfactant, sodium dodecylsulfonate SDS, in 3010 g of ion-exchanged water was put into a separable 500 ml flask having a stirring device, a temperature sensor, a cooler and a nitrogen introducing device. The temperature of the solution was raised by 80° C. while stirring at a speed of 230 rpm under a nitrogen stream. To the surfactant solution an initiator solution prepared by dissolving 9.2 g of an initiator, potassium per sulfate KPS, in 200 g of ion-exchanged water is added and the temperature of the solution was adjusted to 75° C. Then a monomer mixture liquid composed of 0.1 g of styrene, 19.9 g of n-butyl acrylate and 10.9 g of methacrylic acid was dropped to the foregoing solution spending 1 hour. This system was heated and stirred for 2 hours at 75° C. to carry out polymerization or the first step of polymerization. Thus latex, a dispersion of resin particles composed of the polymer resin, was prepared. The latex was referred to as Latex 1H.

(2) Formation of Intermediate Layer (The Second Step of Polymerization)

In a flask attached with a stirring device, 72.0 g of an ester compound, pentaerythritol tetraarachiate was added to a monomer mixture composed of 105.6 g of styrene, 30.0 g of n-butyl acrylate, 6.4 g of methacrylic acid and 5.6 g of n-octyl 3-mercaptopropionate. Thus obtained mixture was dissolved by heating by 80° C. to prepare a monomer solution.

Besides, a surfactant solution composed of 1.6 g of anionic surfactant SDS dissolved in 270 ml of ion-exchanged water was heated by 80° C. To the surfactant solution, 28 g in terms of solid composition of the foregoing Latex 1H, the dispersion of the core particles, was added. Then the foregoing monomer solution containing the ester compound, pentaerythritol tetraarachiate, was dispersed in the surfactant solution by a mechanical dispersing machine CLEARMIX having a circulation channel, manufactured by M-Technique Co., Ltd., to prepare a dispersion or emulsion containing emulsified particles, oil particles, each having a uniform particle diameter of 284 nm.

An initiator solution composed of 5.1 g of the polymerization initiator KPS and 240 ml of ion-changed water and 750 ml of ion-exchanged water were added to the foregoing emulsion. Thus prepared system was heated and stirred for 3 hours at 80° C. to carry out polymerization, the second step of polymerization to obtain latex which was referred to as Latex 1HM. Latex 1HM is a dispersion of compound resin particles in each of which a particle composed of a high molecular weight polymer resin is covered with a medium molecular weight polymer.

(3) Formation of Outer Layer (The Third Polymerization Step)

An initiator solution composed of 7.4 g of the polymerization initiator KPS and 200 ml of ion-exchanged water was added to the foregoing Latex 1HM, and a monomer mixture liquid composed of 300 g of styrene, 95 g of n-butyl acrylate, 15.3 g of methacrylic acid and 10.4 g of n-octyl 3-mercapptopropionate was dropped spending 1 hour at 80° C. After finish of instillation, the mixture liquid was heated and stirred for 2 hours to carry out polymerization, the third step of polymerization. The reaction liquid was cooled by 28° C. to obtain latex which is referred to as Latex 1HML. The latex is a dispersion of compound resin particles each composed of a core of high molecular weight polymer resin, an intermediate layer composed of medium molecular weight polymer resin and an outer layer composed of low molecular weight polymer resin.

The compound resin particle constituting Latex 1HML had peaks of molecular weight at 138,000, 80,000 and 13,000, and the number average particle diameter of the particles was 102 nm.

Preparation of the example colored particles 1BK and 2BK and that of the comparative colored particle examples 1*b*K to 4*b*K is described below. In 1600 ml of ion-exchanged water, 59.0 g of sodium n-dodecylsufate was dissolved. To the solution, 420.0 g of carbon black Regal 330, manufactured by Cabot Co., Ltd., was gradually added while stirring. Then the carbon black was dispersed by CLEARMIX, manufactured by M-Technique Co., Ltd., to prepare a dispersion of the colorant particle, hereinafter referred to as "colorant dispersion". The size of the colorant particle in the colorant dispersion was measured by an electrophoretic light scattering photometer ELS-800, manufactured by Ootsuka Densi Co., Ltd. The weight average particle diameter of the colorant particles was 98 nm.

In a reaction vessel having a temperature sensor, a cooler, a nitrogen introducing device, a stirring device and an apparatus for monitoring size and shape of particle, 420.7 g, in terms of solid composition, of Latex 1HML, 900 g of ion-exchange water and 166 g of the colorant dispersion was charged and stirred. The interior temperature was adjusted at 30° C. and the pH value of the liquid was adjusted to 11.0 by addition of 5N sodium hydroxide solution.

To the liquid, a solution composed of 12.1 g of magnesium chloride hexahydrate dissolved in 1,000 ml of ion-exchanged water was added at 30° C. for 10 minutes while stirring. After standing for 3 minutes, the liquid temperature was raised by 90°+3° C. spending 6–10 minutes with a raising rate of 10° C./min. In this situation, the diameter of the associated particle was measured by Coulter Counter TA-II. Then an aqueous solution composed of 80.4 g of sodium chloride and 1,000 ml of ion-exchanged water was added to stop growing of the particle when the particle size was attained to the desired value. The liquid was ripened by heating and stirring at 85±2° C. for 0.5 to 15 hours to continue the association. Then the liquid is cooled in a rate of 8° C./min. by 30° C., and the pH of the liquid was adjusted to 2.0 by adding hydrochloric acid and stirring was stopped. The associated particles thus formed were filtered using a Buchner funnel and repeatedly washed by ion-exchanged water. Thereafter, the particles were dried by a flush jet drier with an intake air temperature of 60° C. and further dried by a fluidized bed drier at 60° C. Thus colored particles containing the ester compound, pentaerythritol tetraarachiate were obtained. Colored particles 1BK and 2BK and comparative colored particles 1*b*K through 4*b*K each having the shape property and the particle diameter distribution property shown in Tables 1 and 2 were obtained by controlling the timing of addition of sodium chloride solution, the rotating number of stirring and the heating duration at the foregoing salting/associating and shape controlling steps.

Colored particle 2Y and comparative colored particle 3*y* and 4*y* are described below.

In 1,600 ml of ion-exchanged water, 90 g of anionic surfactant SDS was dissolved by stirring. To thus obtained solution, 420 g of a dye, C. I. Solvent Yellow 93, was gradually added, and dispersed by CLEARMIX, manufactured by M•Technique Co., Ltd., to prepare a dispersion of the colorant particle, hereinafter referred to as "colorant dispersion Y". The diameter of the colorant particle in colorant dispersion Y is measured by the electrophoretic light scattering photometer ELS-800, Ootsuka Densi Co., Ltd. The weight average particle diameter was 250 nm. Colored particles were prepared in the same manner as in the example colorant particles 1BK, 2BK and comparative colorant particles 1*b*K through 4*b*K except that the 168 g of Colorant dispersion Y was used in place of 166 g of Colorant dispersion Bk. Thus obtained colored particles were referred to as "colored particle 2Y" and "comparative colored particles 3*y* and 4*y*", respectively.

Example colored particle 2M and comparative colored particles 3*m* and 4*m* are described below.

In 1,600 ml of ion-exchanged water, 90 g of anionic surfactant SDS was dissolved by stirring. To thus obtained solution, 420 g of a pigment, C. I. Pigment Red 122, was gradually added, and dispersed by CLEARMIX, manufactured by M•Technique Co., Ltd., to prepare a dispersion of the colorant particle, hereinafter referred to as "colorant dispersion M". The diameter of the colorant particle in Colorant dispersion M is measured by the electrophoretic light scattering photometer ELS-800, Ootsuka Densi Co., Ltd. The weight average particle diameter was 250 nm. Colored particles were prepared in the same manner as in the example colorant particles 1BK, 2BK and comparative colorant particles 1*b*K through 4*b*K except that the 168 g of Colorant dispersion M was used in place of 166 g of Colorant dispersion Bk. Thus obtained colored particles were referred to as "colored particle 2M" and "comparative colored particles 3*m* and 4*m*", respectively.

Example colored particle 2C and comparative colored particles 3*c* and 4*c* are described below.

In 1,600 ml of ion-exchanged water, 90 g of anionic surfactant SDS was dissolved by stirring. To thus obtained solution, 400 g of a pigment, C. I. Pigment Blue 15:3, was gradually added, and dispersed by CLEARMIX, manufactured by M•Technique Co., Ltd., to prepare a dispersion of the colorant particle, hereinafter referred to as "colorant dispersion C". The diameter of the colorant particle in Colorant dispersion C is measured by the electrophoretic light scattering photometer ELS-800, Ootsuka Densi Co., Ltd. The weight average particle diameter was 250 nm. Colored particles were prepared in the same manner as in the example colorant particles 1BK, 2BK and comparative colorant particles 1*b*K through 4*b*K except that the 168 g of colorant dispersion C was used in place of 166 g of Colorant dispersion Bk. Thus obtained colored particles were referred to as "colored particle 2C" and "comparative colored particles 3*c* and 4*c*", respectively.

To each of thus obtained colored particles 1BK and 2BK, comparative colored particles 1*b*K through 4*b*K, colored particles 2Y, comparative colored particles 3*y* and 4*y*, colored particles 2M, comparative colored particles 3*m* and 4*m*, colored particles 2C, and comparative colored particles 3*c* and 4*c*, 1% by weight of hydrophobic silica having a number average primary particle diameter of 10 nm and a hydrophobic degree of 63, 0.8% by weight of hydrophobic titanium oxide having a number average primary particle diameter of 25 nm and a hydrophobic degree of 60, and 0.1% by weight of zinc stearate were added and mixed by a Henschel mixer to prepare toners. The shape and the particle diameter of each of the colored particle were not varied by the addition of the external additives.

A developing device and an image forming apparatus can be provided by the invention, by which the fluctuation of the dot diameter caused by the aggregate of the toner can be inhibited within the range in which the noise after development of the image is not recognized and the noise on the final image can be reduced.

Moreover, a developing device and an image forming apparatus can be provided by the invention, by which the fluctuation of the dot diameter caused by the aggregate of the toner by repeating the transfer of the toner can be inhibited and the range of the fluctuation after development can be reduced so as to decrease the noise on the final image.

What is claimed is:

1. A developing device for developing a static latent image composed of dots formed on an image carrier, in which the relation between an average of the circle corresponding diameter of the toner aggregates in the toner image on the image carrier surface formed by developing the static latent image and a value obtained by dividing the standard deviation of a circle corresponding diameter of the toner aggregate by the average circle corresponding diameter of the toner aggregates satisfies the following formula:

$$0<Y<179.01\times X^{-1.9031}$$

wherein X is a diameter of the circle corresponding to toner aggregate in $\mu$m (X>20 $\mu$m), and Y is CV1, where CV1=Standard deviation of the circle corresponding diameter of the toner aggregate/Average of the circle corresponding diameter of the toner aggregates X.

2. The developing device of claim 1 wherein volume average particle diameter of the toner particles is preferably from 2 to 7 $\mu$m.

3. The developing device of claim 1 wherein volume variation coefficient of the toner is not more than 22.

4. The developing device of claim 1 wherein in a histogram showing the particle diameter distribution based on the particle number in which natural logarithm ln D classified by every 0.23 is taken on the horizontal axis, wherein D is the particle diameter of the toner particle in $\mu$m, and the sum M of the relative number m1 of the toner particles included in the class of the highest frequency and the relative number m2 of the toner particles included in the class of next high frequency is not less than 65%.

5. The developing device of claim 1 wherein a ratio of the toner particles having the foregoing shape coefficient of the toner of from 1.2 to 1.6 is not less than 60% by volume and variation coefficient of the shape coefficient is not more than 18%.

6. The developing device of claim 1 wherein an alternating current voltage overlapped with a direct current voltage is applied to a developer carrier charged in the developing device.

7. A developing device for developing a static latent image composed of dots formed on image carriers, wherein the developing device is contained in an image forming apparatus by which four color images are each formed on one of the image carriers by developing by the toners Y, M, C and K, respectively, and the images are successively transferred onto a same intermediate transferring member or a same recording medium set on the intermediate transferring member; and relation between the average of the circle corresponding diameter of the toner aggregates of the toner image on the image carrier surface formed by developing the static latent image and the value obtained by dividing the standard deviation of the diameter of the circle corresponding to the toner aggregate by the average diameter of the circle corresponding to the toner aggregates, satisfies the following formula:

$$0<Y<90.307\times X^{-1.7589}$$

wherein X is an average circle corresponding diameter of the toner aggregate in $\mu$m (X>20 $\mu$m), and Y is CV1, where CV1=Standard deviation of the circle corresponding diameter of the toner aggregate/Average diameter of the circle corresponding to the toner aggregates X.

8. The developing device of claim 7 wherein volume average particle diameter of the toner particles is preferably from 2 to 7 $\mu$m.

9. The developing device of claim 7 wherein volume variation coefficient of the toner is not more than 22.

10. The developing device of claim 7 wherein in a histogram showing the particle diameter distribution based on the particle number in which natural logarithm ln D classified by every 0.23 is taken on the horizontal axis, wherein D is the particle diameter of the toner particle in $\mu$m, and the sum M of the relative number m1 of the toner particles included in the class of the highest frequency and the relative number m2 of the toner particles included in the class of next high frequency is not less than 65%.

11. The developing device of claim 7 wherein a ratio of the toner particles having the foregoing shape coefficient of the toner of from 1.2 to 1.6 is not less than 60% by volume and variation coefficient of the shape coefficient is not more than 18%.

12. The developing device of claim 7 wherein an alternating current voltage overlapped with a direct current voltage is applied to a developer carrier charged in the developing device.

* * * * *